United States Patent [19]

Porenski, Jr.

[11] 4,446,878

[45] May 8, 1984

[54] CIGARETTE FILTER

[75] Inventor: Harry S. Porenski, Jr., Louisville, Ky.

[73] Assignee: Brown & Williamson Tobacco Corporation, Louisville, Ky.

[21] Appl. No.: 303,737

[22] Filed: Sep. 21, 1981

[51] Int. Cl.[3] ..... A24B 3/04

[52] U.S. Cl. ..... 131/336

[58] Field of Search ..... 131/339, 336

[56] References Cited

U.S. PATENT DOCUMENTS

| | | | |
|---|---|---|---|
| 4,188,847 | 2/1980 | Payne | 131/281 |
| 4,331,166 | 5/1982 | Hale | 131/339 |
| 4,362,171 | 12/1982 | Johnson et al. | 131/336 |

*Primary Examiner*—V. Millin

*Attorney, Agent, or Firm*—Charles G. Lamb

[57] ABSTRACT

A filter for a cigarette which includes means at the mouth end thereof to divert the exiting smoke in a lateral direction.

3 Claims, 5 Drawing Figures

CIGARETTE FILTER

BACKGROUND OF THE INVENTION

1. Field of the Invention

This invention relates to filters for cigarettes. In one aspect, it relates to a filter with means to direct the exiting smoke from the filter in a lateral direction. In another aspect, the invention relates to the use of apertures circumabiently arranged around the circumference of the filter adjacent to the mouth end of the filter to direct at least part of the smoke exiting the filter laterally therefrom.

2. Description of the Prior Art

In the manufacture of filters for cigarettes which are in the low and ultra-low tar (1 mg. to 10 mg.) category, most of the filters use a large quantity of ventilating air which is generally introduced into the filter to reduce the tar in the smoke stream through dilution. In most of the commercially available products of the low and ultra-low tar category, so much ventilating air is added into the filter that the smoke is concentrated in the center of the filter and, during smoke draw, enters the smoker's mouth horizontally or longitudinally in a very fine stream thereby missing many of the "taste buds"; thus, delivering very little taste.

There have been suggested many different types of filters for cigarettes wherein the filters are provided with means to alter the flow of the smoke stream passing therethrough in anticipation of improving efficiency of the filter. These include, for example, U.S. Pat. No. 2,833,289; U.S. Pat. No. 3,496,945; and, U.S. Pat. No. 2,849,005. However, none of these teach means to physically direct the smoke exiting from the filter in a lateral direction.

SUMMARY OF THE INVENTION

The present invention advantageously provides a straight forward arrangement of a filter for a cigarette with improved flow directing properties. The present invention further provides a cigarette filter for dispersing the flow of the smoke leaving the filter in a lateral direction. The present invention even further provides a filter for a cigarette utilizing a baffle on the mouth end of the filter in combination with a plurality of holes circumambiently surrounding the mouth end of the filter adjacent said mouth end to laterally disperse the smoke leaving the filter.

Various other features of the present invention will become obvious to those skilled in the art upon reading the disclosure set forth hereinafter.

More particularly, the present invention provides a filter for a cigarette comprising:

- a porous filter rod of cylindrical configuration having an opposed inlet and outlet end;
- a filter wrapper extending longitudinally of and circumscribing the rod leaving the opposed ends in flow through communication; and,
- apertures arranged circumambiently of the filter adjacent the outlet end whereby smoke exiting the filter is dispersed laterally.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the Drawing

DESCRIPTION OF THE PREFERRED EMBODIMENT

Figure 1:
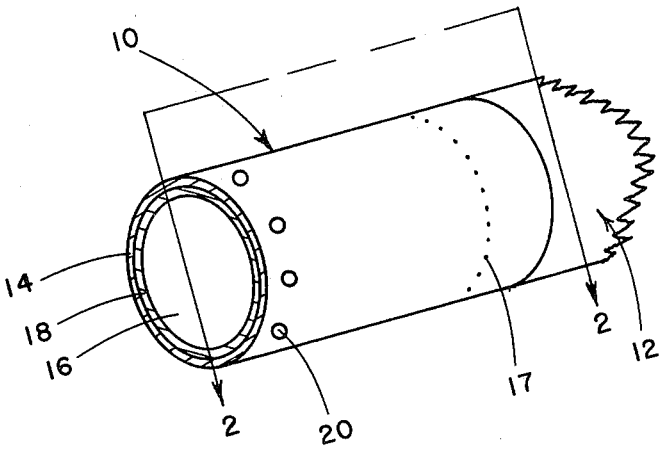
FIG. 1 is a perspective view of one preferred filter of the present invention attached to a cigarette.
Figure 2:
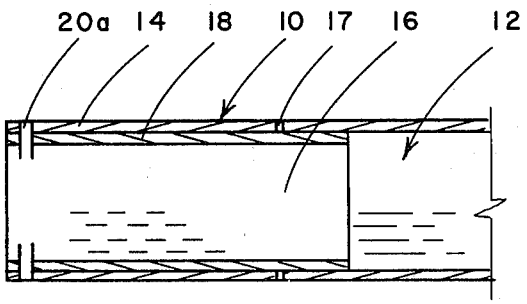
FIG. 2 is a sectional view of the filter of FIG. 1 taken along the lines 2—2.
Figure 3:
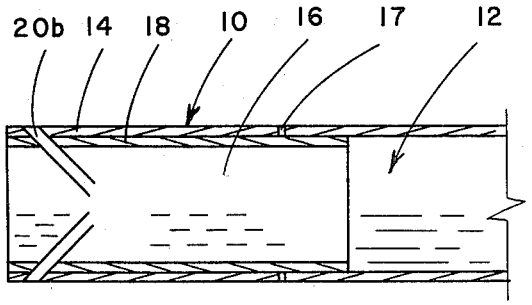
FIG. 3 is a sectional view of the filter of FIG. 1 taken along the lines 2—2, but showing another preferred means for diverting the smoke from the filter in a lateral direction.

In FIGS. 1, 2 and 3, a filter 10 is shown attached to a cigarette column 12 by a tipping paper or material 14. The filter 10 includes a cellulose acetate filter element 16 or any other filter made from fibrous or foam materials for tobacco smoke which may be known in the art, circumscribed by a wrapping material 18, commonly referrred to as plug wrap. The plug wrap 18 may be porous or non-porous and also the plug wrap may include outer surfaces of foam material which are integral with the filter element as well as wrapping material which is not integral with the filter plug. In most conventional cigarettes, the plug wrapper 18 is porous and the tipping material 14 is provided with a plurality of openings 17 therein to provide ventilating air into the filter element 16 to dilute the smoke stream passing therethrough.

Adjacent to the mouth end or the smoke outlet end of the filter 10 is a plurality of apertures 20 extending into the filter element to divert laterally a portion of the smoke exiting the filter 10. In FIG. 2 the exit smoke apertures are identified by the numeral 20*a*, wherein the apertures extend radially a short distance into the filter element whereas in FIG. 3 the smoke outlet apertures are identified by the numeral 20*b* and extend at an angle substantially into the filter and are inwardly directed towards the central axis. The location of the aperture 20 is adjacent to the end of the filter 10. Futhermore, the location of the apertures 20 and where they extend into the filter will be determined upon the amount of smoke that has been determined to be removed from the filter through the apertures 20 as well as the size and number of apertures would be determined depending upon the amount of smoke to be moved therethrough.

Figure 4:
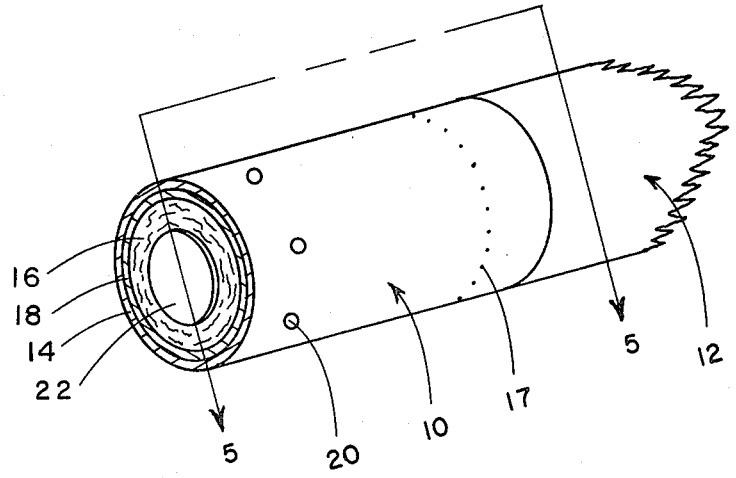
FIG. 4 is a perspective view of another preferred filter of the present invention attached to a cigarette; and, FIG. 5 is a sectional view of the filter of FIG. 4 taken along the lines 5—5.
Figure 5:
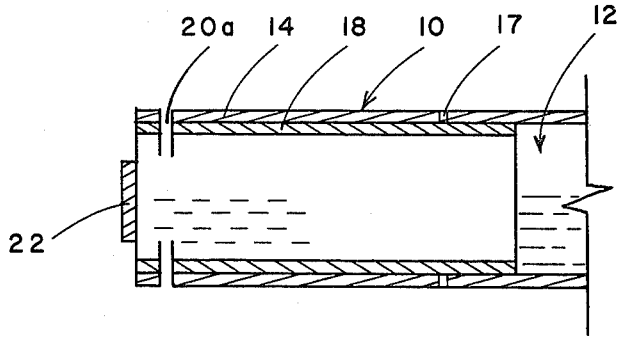

In FIGS. 4 and 5, the filter of FIGS. 1 and 2 has been provided with a smoke impervious material such as an impervious baffle 22 of thin plastic over the outlet or mouth end of the filter. The baffle 22 is shown as being adhesively secured to the filter element 16, but it is realized that it may be embedded into the filter element as well. It is also realized that even though the baffle 22 is shown as covering only a portion of the outlet or mouth end of the filter, it is realized that the baffle 22 may cover substantially the entire mouth end of the filter thereby forcing all of the smoke laterally from the filter through the apertures 20.

It would also be realized that various changes may be made to the specific embodiment shown and described without departing from the principles and scope of the present invention.

What is claimed is:

1. A filter for a cigarette comprising:

a porous filter rod of cylindrical configuration having opposed inlet and outer ends;

a filter rod wrapper extending longitudinally of and circumscribing the rod leaving the opposed ends in flow through communication;

tipping paper circumscribing said filter rod wrapper;

ventilating air means in said filter rod wrapper and said tipping paper to provide ventilating air to said filter element; and, a plurality of apertures circumambiently arranged around the outlet end and adjacent thereto for directing the smoke from the filter in a lateral direction, said apertures being longitudinally spaced from said ventilating air means.

2. The filter of claim 1 wherein the apertures are directed radially into the filter rod.

3. The filter of claim 1 wherein the apertures are angularly directed toward the central axis of the filter rod away from the outlet end.

* * * * *